US007117950B2

(12) United States Patent
McLane, Jr.

(10) Patent No.: US 7,117,950 B2
(45) Date of Patent: Oct. 10, 2006

(54) FIRE SUPPRESSION SYSTEM

(76) Inventor: Samuel D. McLane, Jr., 310 Maple St., Clinton, TN (US) 37716

( * ) Notice: Subject to any disclaimer, the term of this patent is extended or adjusted under 35 U.S.C. 154(b) by 186 days.

(21) Appl. No.: 10/862,502

(22) Filed: Jun. 7, 2004

(65) Prior Publication Data

US 2005/0269111 A1 Dec. 8, 2005

(51) Int. Cl.
*A62C 35/00* (2006.01)

(52) U.S. Cl. ..... 169/9; 169/56; 169/61; 169/62; 169/85; 169/88; 169/DIG. 3

(58) Field of Classification Search ..... 169/9, 169/26, 33, 35, 36, 56, 58, 59, 61, 62, 65, 169/71, 72, 74, 85, 89
See application file for complete search history.

(56) References Cited

U.S. PATENT DOCUMENTS 3,754,602 A * 8/1973 Magdars ..... 169/60
3,949,812 A 4/1976 Hay
3,986,560 A 10/1976 Heath et al.
4,026,465 A 5/1977 Kenny
4,042,521 A 8/1977 Dunn
4,073,464 A 2/1978 Hansen et al.
4,109,726 A 8/1978 Hansen et al.
4,136,851 A 1/1979 Hansen et al.
4,217,959 A 8/1980 Poulsen
4,224,538 A 9/1980 Cholin
4,227,577 A 10/1980 Iida
4,256,181 A 3/1981 Searcy
4,265,316 A 5/1981 Fee
4,305,469 A 12/1981 Morrisette
4,313,501 A 2/1982 Eckert
4,373,588 A 2/1983 White et al.
4,423,784 A * 1/1984 Bolen ..... 169/62
4,520,871 A 6/1985 Miller et al.
4,580,638 A 4/1986 Jones et al.
4,651,952 A 3/1987 Tavano
4,664,199 A 5/1987 Grant et al.
4,779,683 A 10/1988 Enk (Continued)

*Primary Examiner*—Eric Keasel
*Assistant Examiner*—Jason Boeckmann
(74) *Attorney, Agent, or Firm*—Pitts & Brittian, P.C.

(57) ABSTRACT

A vehicular and marine fire suppression system for detecting and suppressing and quenching fires. The vehicular and marine fire suppression system including a first canister, a second canister and an actuation mechanism. The first canister houses a fire suppressing agent and is in fluid communication with a manifold assembly for providing delivery of the fire suppression agent from the first canister to the area to be protected by the fire suppression system. The second canister contains a pressurizing/agitation agent and is in fluid communication with the first canister via a valved actuator assembly. The second canister includes a threaded neck defining an outlet and a pierceable seal disposed about the outlet. The actuator assembly includes a piercing member for rupturing the pierceable seal of the second canister. The piercing member is in active engagement with a piston carried by a squib. Ignition of an explosive agent within the squib is used to drive the piston to an extended position thus causing the piercing member to rupture the pierceable seal of the first canister. State-of-the-art heat/smoke detection circuitry and a programmable logic circuit are provided for detecting a fire and delivering an electrical signal to the squib. A handle member and a linkage in operative engagement with the piercing member is provided for manual actuation of the fire suppression system. Alternatively, an electrically actuated solenoid could be used to actuate the piercing member.

4 Claims, 6 Drawing Sheets

U.S. PATENT DOCUMENTS 4,784,354 A 11/1988 Tavano
4,926,815 A 5/1990 Cowley
4,936,388 A 6/1990 Le Lande, Jr.
4,953,624 A 9/1990 Turner
4,986,365 A 1/1991 Shieh
4,995,355 A 2/1991 Cowley
5,016,715 A 5/1991 Alasio
5,048,791 A 9/1991 Ellison et al.
5,063,998 A * 11/1991 Quinn ..... 169/65
5,425,886 A 6/1995 Smith
5,463,926 A 11/1995 Faughn
5,511,456 A 4/1996 Faughn
5,727,635 A * 3/1998 Doty et al. ..... 169/62
6,029,751 A 2/2000 Ford et al.
6,128,904 A 10/2000 Rosso, Jr. et al.
6,189,624 B1 2/2001 James
2003/0047328 A1* 3/2003 Piatti ..... 169/62

* cited by examiner

FIRE SUPPRESSION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to the field of fire suppression systems. More particularly, this invention relates to fire suppression systems that suppress fires originating in vehicular and marine systems and particularly in recreational vehicles.

2. Description of the Related Art

In the fields of vehicular and marine fire suppression, it is well known that effectiveness and efficiency of operation are critical factors in containing and quenching a fire. The importance of such factors is enhanced when considering fires within marine and automotive racing compartments, as well as in recreational vehicles, where escape from an engulfed vehicle is typically unlikely or where there is the potential for a wider scope of injury such as in a marina or a multi-car collision. In U.S. Pat. No. 5,727,635, ("the '635 patent"), McLane, the inventor of the present invention, along with Michael Doty disclosed a novel fire suppression system for use in vehicular or marine environments. And, while McLane and Doty taught that their fire suppression system was capable of manual, electrical, pneumatic or thermal activation, or of activation by any combination of those methods, they did not disclose a system for providing electrical and manual actuation of the fire suppression system. And, it will be appreciated by those skilled in the art that it is often desirable to provide for both automatic actuation, i.e. actuation controlled by an electronic controller or processor in communication with one or more sensors, and manual actuation.

Other fire suppression systems are known in the art. Typical of the art are those devices disclosed in the following U.S. patents:

| U.S. Pat. No. | Inventor(s) | Issue Date |
|---|---|---|
| 5,727,635 | Doty et al. | Mar. 17, 1998 |
| 6,189,624 | James | Feb. 20, 2001 |
| 4,423,784 | Bolen | Jan. 3, 1984 |
| 4,265,316 | Fee | May 5, 1981 |
| 4,580,638 | Jones et al. | Apr. 8, 1986 |
| 3,949,812 | Hay | Apr. 13, 1976 |
| 3,986,560 | Heath et al. | Oct. 19, 1976 |
| 4,026,465 | Kenny | May 31, 1977 |
| 4,042,521 | Dunn | Aug. 16, 1977 |
| 4,073,464 | Hansen et al. | Feb. 14, 1978 |
| 4,109,726 | Hansen et al. | Aug. 29, 1978 |
| 4,136,851 | Hansen et al. | Jan. 30, 1979 |
| 4,217,959 | Poulsen | Aug. 19, 1980 |
| 4,224,538 | Cholin | Sep. 23, 1980 |
| 4,227,577 | Iida | Oct. 14, 1980 |
| 4,256,181 | Searcy | Mar. 17, 1981 |
| 4,305,469 | Morrisette | Dec. 15, 1981 |
| 4,313,501 | Eckert | Feb. 2, 1982 |
| 4,373,588 | White et al. | Feb. 15, 1983 |

-continued

| U.S. Pat. No. | Inventor(s) | Issue Date |
|---|---|---|
| 4,520,871 | Miller et al. | Jun. 4, 1985 |
| 4,651,952 | Tavano | Mar. 24, 1987 |
| 4,664,199 | Grant et al. | May 12, 1987 |
| 4,779,683 | Enk | Oct. 25, 1988 |
| 4,784,354 | Tavano | Nov. 15, 1988 |
| 4,926,815 | Cowley | May 22, 1990 |
| 4,936,388 | Le Lande, Jr. | Jun. 26, 1990 |
| 4,953,624 | Turner | Sep. 4, 1990 |
| 4,986,365 | Shieh | Jan. 22, 1991 |
| 4,995,355 | Cowley | Feb. 26, 1991 |
| 5,016,715 | Alasio | May 21, 1991 |
| 5,048,791 | Ellison et al. | Sep. 17, 1991 |
| 5,063,998 | Quinn | Nov. 12, 1991 |
| 5,425,886 | Smith | Jun. 20, 1995 |
| 5,463,926 | Faughn | Nov. 7, 1995 |
| 5,511,456 | Faughn | Apr. 30, 1996 |
| 6,029,751 | Ford et al. | Feb. 29, 2000 |
| 6,128,904 | Rosso, Jr. et al. | Oct. 10, 2000 |

None of these devices disclose an automatic actuation system that can be readily, easily and efficiently adapted to the actuation mechanism of the '635 patent.

BRIEF SUMMARY OF THE INVENTION

The present invention is primarily an improvement of the technology disclosed in the '635 patent. In this regard, a ram housing is positioned proximate to the actuation mechanism. The ram housing includes a ram that is in active engagement with a piercing member for piercing a pierceable seal on the second canister that houses the agitation/pressurization agent. The ram engages the piercing member without interfering with the operation of the mechanical linkage that is provided for manual actuation and discharge of the fire suppression system. The ram housing receives a piston body that is electrically actuated. The piston body is in electrical communication with a controller which is, in turn, in electrical communication with at least one sensor, such as a thermocouple or other heat sensor or smoke sensor for detecting one or more of the products of combustion. Upon detection of a fire, the controller sends an electrical signal to the piston body. The piston body is responsive to the electrical signal and causes the piston to movingly engage the ram. Linear movement of the ram causes the ram to engage the piercing member so as to pierce the pierceable seal on the second canister.

In one embodiment, the piston body is a squib that contains an explosive material. The explosive material can be gun powder, plastic explosive or other types of explosive material. Ignition of the explosive material, in response to an electrical signal from the controller, results in creation of a high pressure gas that propels the piston outward. It is this propulsive effect that causes the piston to engage the ram and thereby actuate the piercing member.

In an alternate embodiment, the piston body is an electrically driven solenoid which causes the piston to move from a retracted position to an extended position thereby driving the ram and actuating the piercing member.

A manifold is provided for delivery of the fire suppressant from the first canister to at least one selected location. While the present fire suppression system is readily adaptable to both vehicular and marine applications, it is particularly beneficial to the recreational vehicle, or RV, industry. In this regard, the system could be energized by the generator and the manifold could deliver the fire suppression agent to the engine compartment and the generator compartment.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
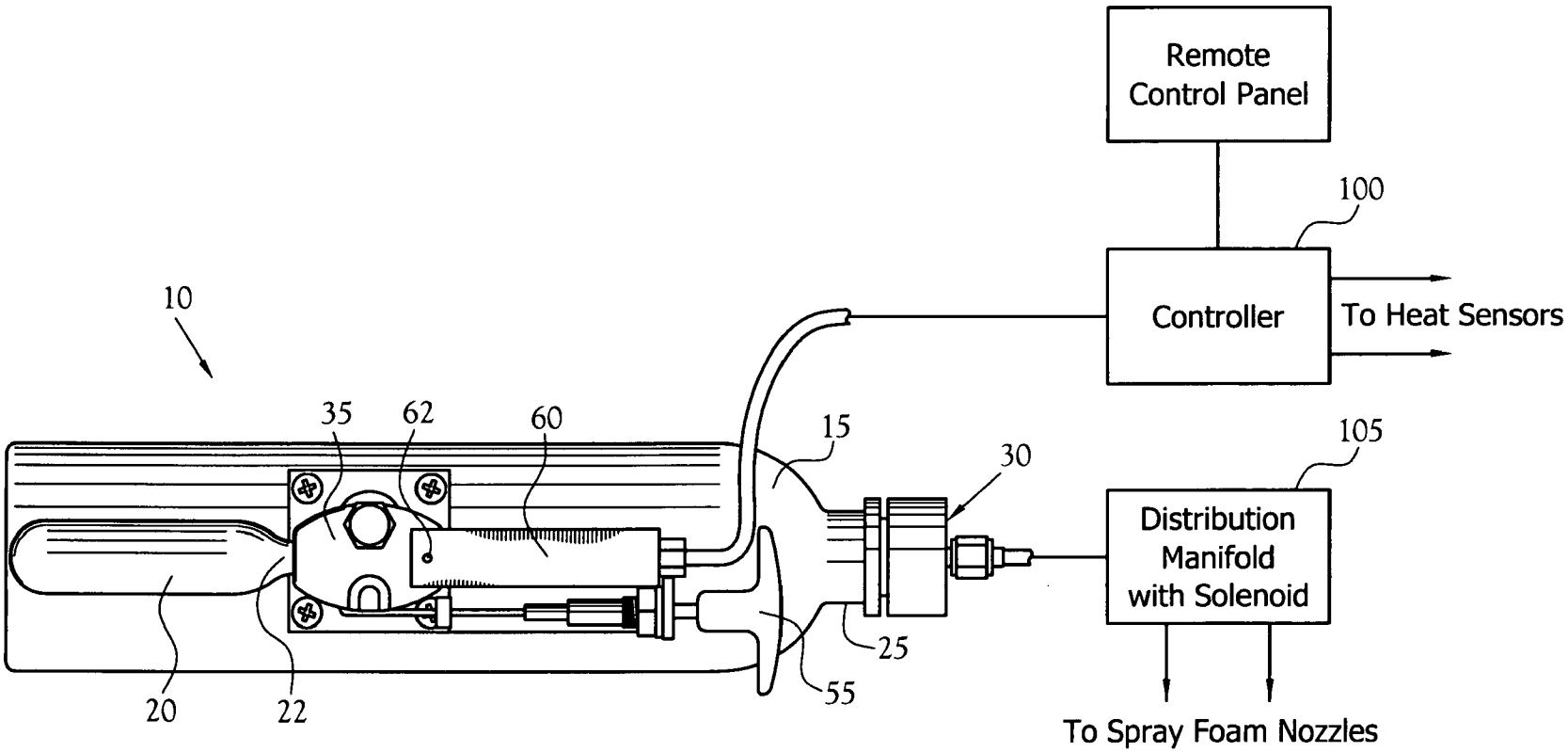
FIG. 1 is an elevation view of the vehicular and marine fire suppression system constructed in accordance with several features of the present invention.
Figure 2:
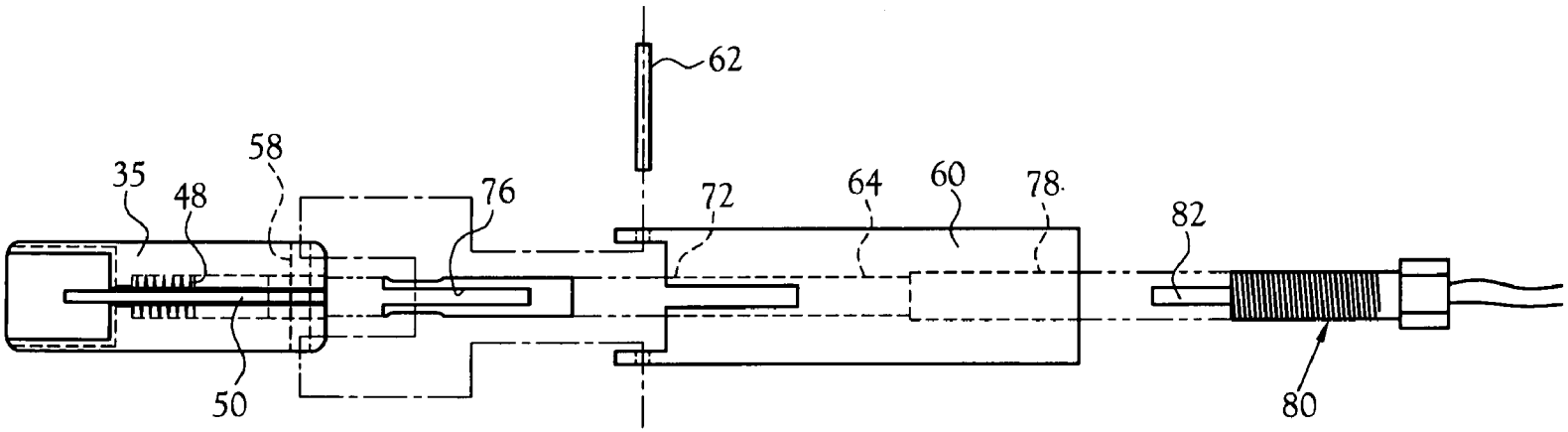
FIG. 2 is an exploded side view of the actuating mechanism, in partial section.
Figure 3:
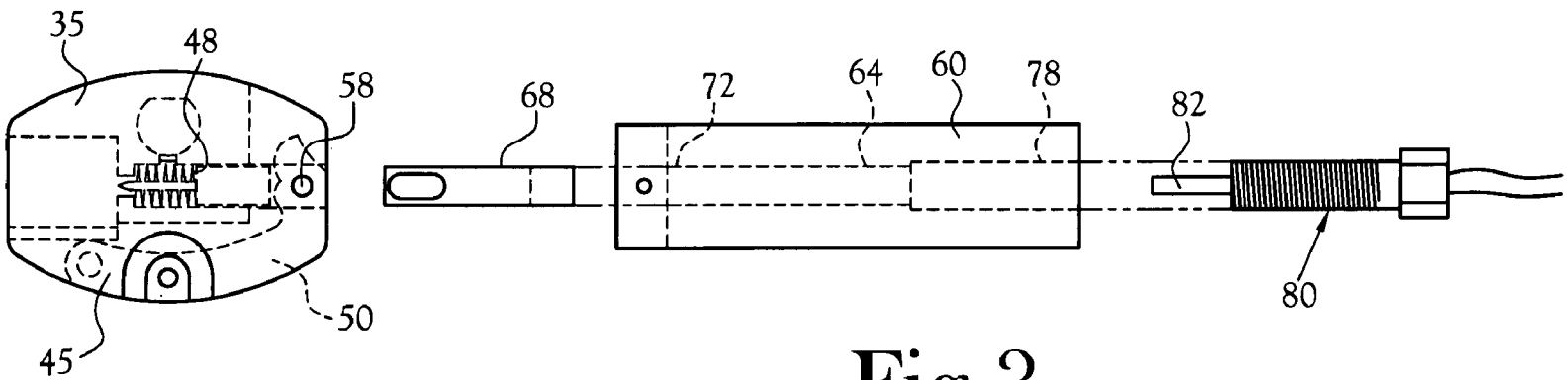
FIG. 3 is an exploded elevation view of the actuating mechanism.
Figure 4:
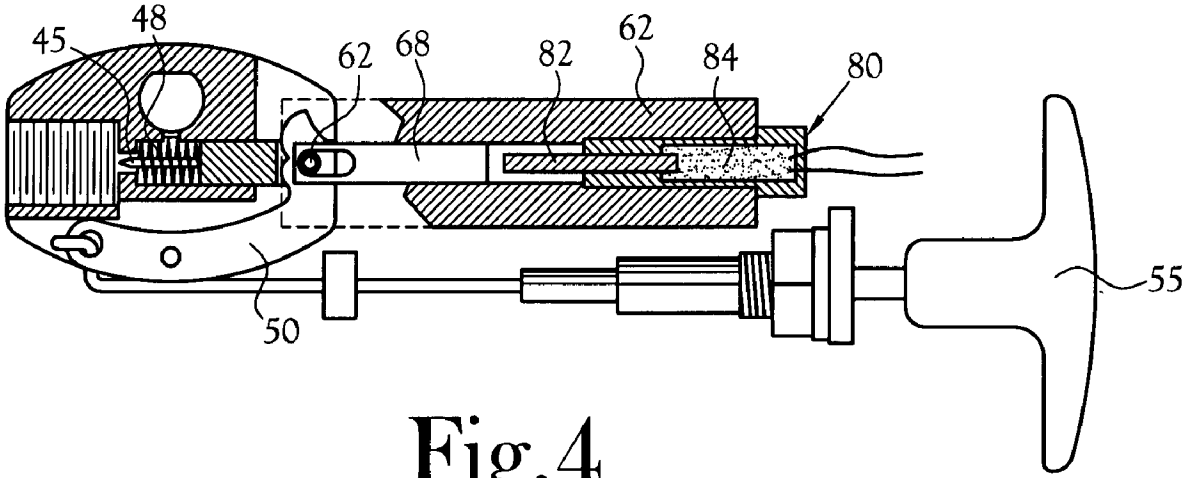
FIG. 4 illustrates an elevation view, in section, of the actuating mechanism of the present invention showing the piston and the ram in the retracted position.
Figure 5:
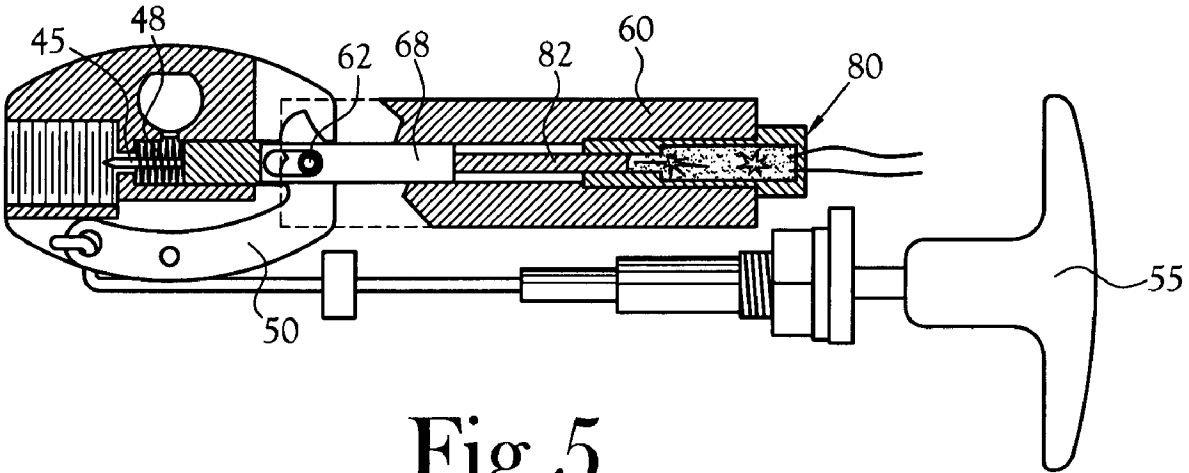
FIG. 5 is an elevation view, in section, of the actuating mechanism of the present invention showing the piston and the ram in the extended position for driving the piercing member forward.
Figure 6:
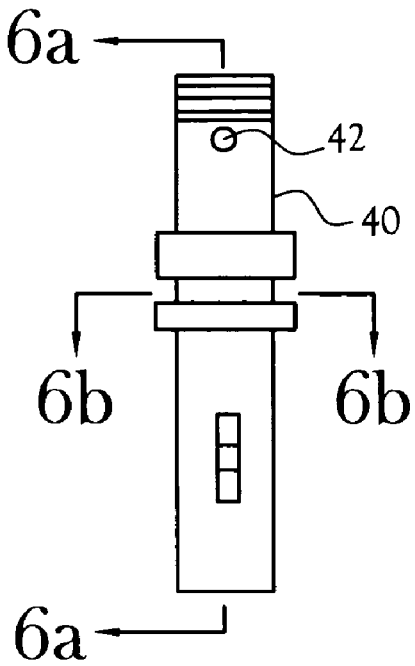
FIG. 6 illustrates an elevation view, of the actuating valve stem of the present invention.
Figure 6A:
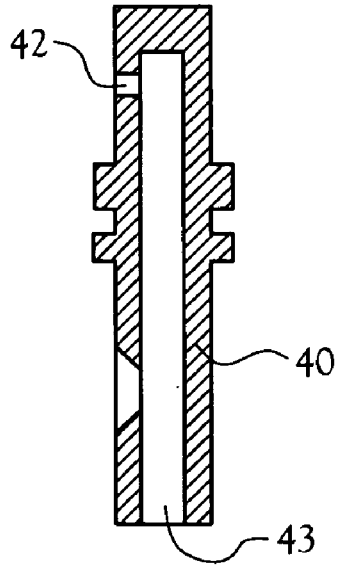
FIGS. 6A & 6B illustrate elevation and plan views, in section, of the actuating valve stem of the present invention, taken at 6A—6A and 6B—6B of FIG. 6, respectively.
Figure 6B:
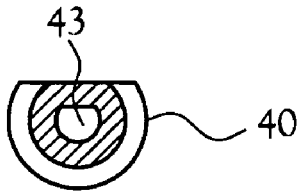

An improved fire suppression system, constructed in accordance with the present invention is illustrated generally as 10 in the figures. As stated above, the present invention is an improvement to the fire suppression system disclosed in the '635 patent. The improved fire suppression system includes a first canister 15 containing a fire suppressing agent. The first canister 15 includes an inlet (not shown) in fluid communication with a second canister 20 containing an agitating and pressurizing agent. The first canister also includes an outlet 25 defining a neck for receiving a discharge mechanism 30. In one embodiment, the second canister 20 is a $CO_2$ cylinder, as is commonly used with $CO_2$ energized projectile firing guns, having an outlet 22 with a pierceable seal (not shown) disposed about the outlet 25. The second canister 20 is received by an actuating mechanism 35 for establishing a fluid communication between the first canister 15 and the second canister 20. The actuating mechanism 35 is secured to the first canister 15 and includes an actuating valve stem 40 (shown in FIG. 6 and described in greater detail below) received within the inlet of the first canister 15. A piercing agent 45 is disposed within the actuating mechanism 35 and is provided in order to pierce the pierceable seal disposed on the outlet 22 of the second canister 20. The piercing agent is biased, preferably by a spring 48, in the retracted position.

In order to allow manual actuation of the fire suppression system, a linkage 50 is provide which is in operative engagement with the piercing agent 45. A handle 55 is provided for manipulating the linkage 50. In operation, upon movement of the handle 55 in an outward direction, the linkage 50 rotates around a pivot point 58 and engages the piercing agent 45 thus causing the agitation/pressurization agent to escape the second canister 20, flow through the actuating mechanism 35 and into the inlet of the first canister 15 via the actuating valve stem 40. In this regard, the actuating valve stem 40 includes at least a first port 42 and a passageway 43 for providing fluid communication between the second canister 20 and the first canister 15.

In order to provide automatic actuation of the fire suppression system 10, a housing 60 is provided and is secured proximate the actuating mechanism 35. The housing 60 has a longitudinal passageway 64 collinear with the piercing agent 45. A ram 68 is disposed in a first end 72 of the longitudinal passageway 64 and is positioned so as to engage the piercing agent 45. The ram 68 is preferably cylindrical and has a slot 76 disposed in a first end of the ram 68. The slot 76 receives a portion of the linkage 50 and allows the ram 68 to engage the piercing agent 45 simultaneously with the linkage 50 and without restricting rotation of the linkage 50 about pivot point 58. In this manner, the slot 76 allows independent actuation of the piercing agent 45 by either the linkage 50 or the ram 68. The housing 60 is secured to the actuating mechanism 35 by a pin 62 which is, preferably, coaxial with the pivot point 58.

Figure 7:
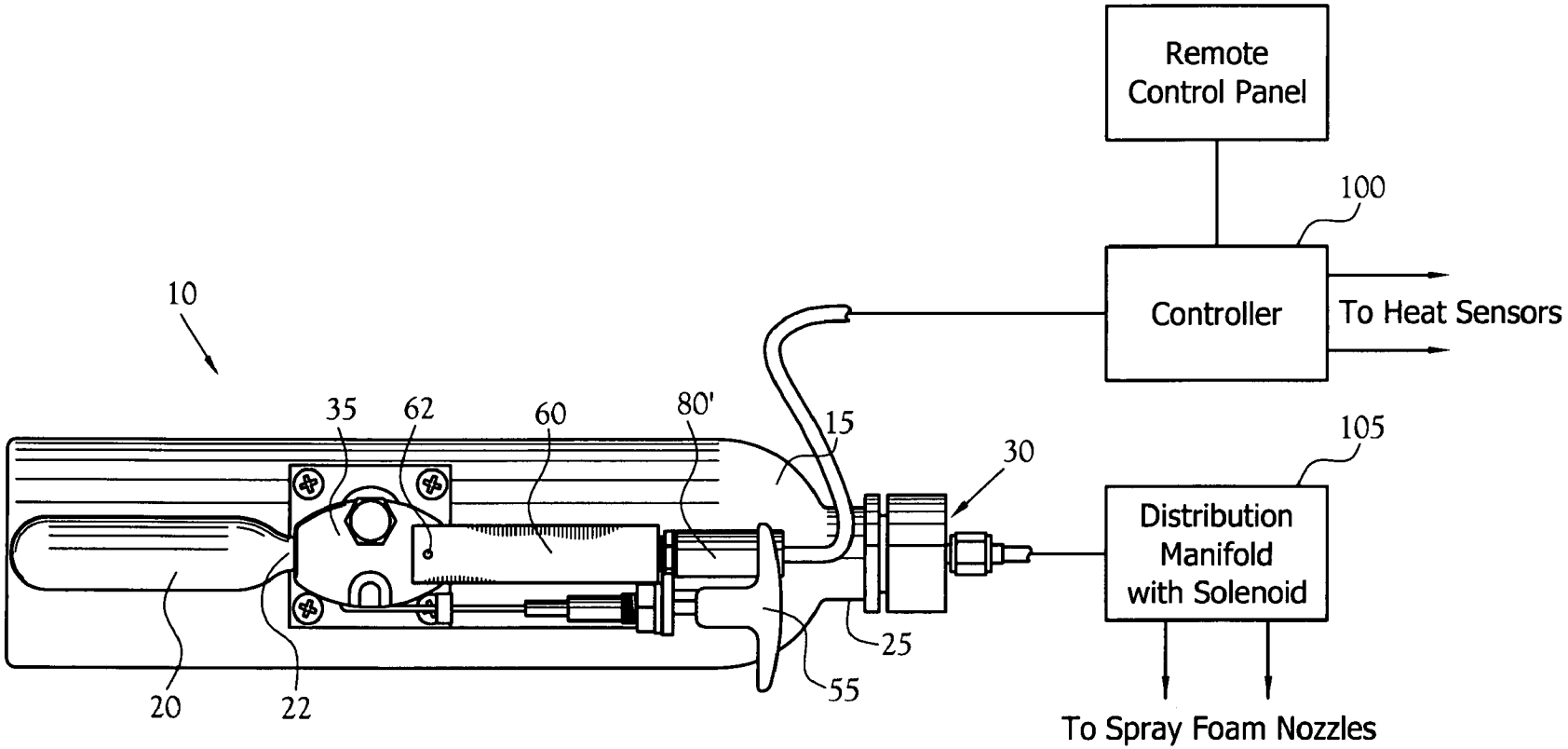
FIG. 7 is an elevation view of the vehicular and marine fire suppression system constructed in accordance with several features of the present invention and having an alternate embodiment impeller mechanism.
Figure 8:
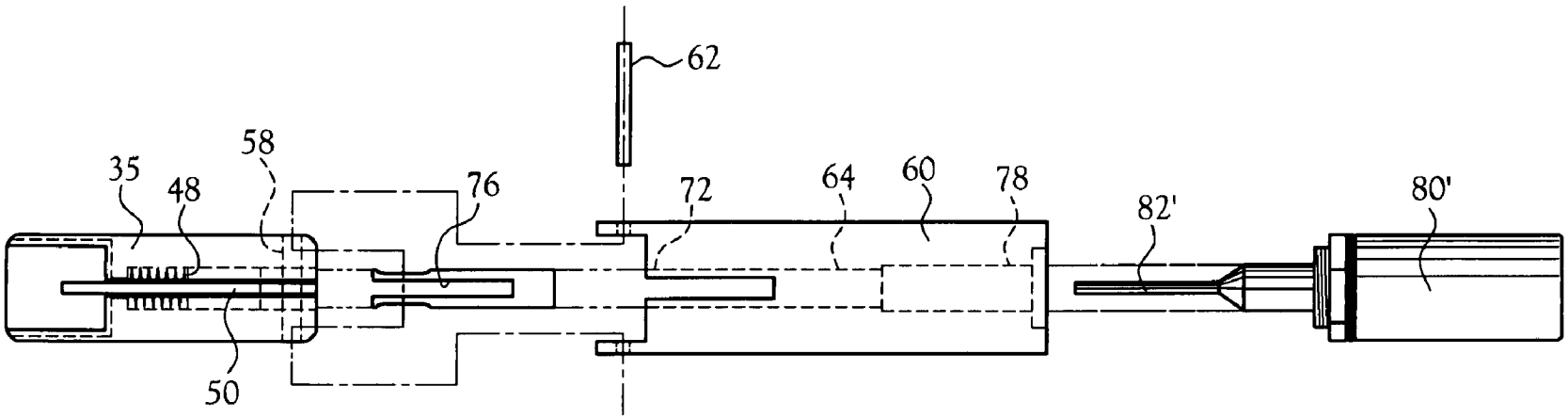
FIG. 8 is an exploded side view of the actuating mechanism, in partial section of the alternate embodiment illustrated in FIG. 7.
Figure 9:
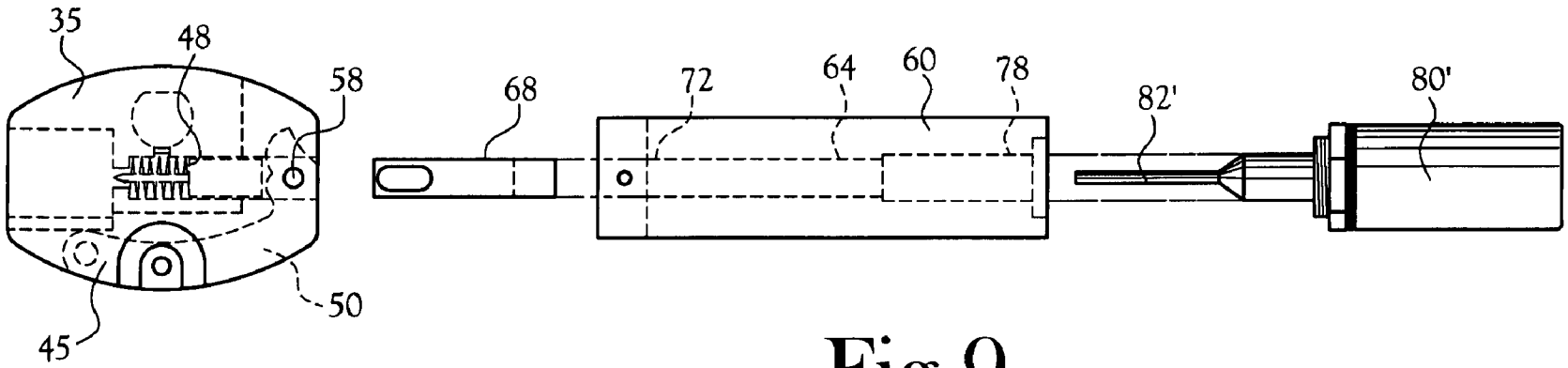
FIG. 9 is an exploded elevation view of the actuating mechanism of the alternate embodiment illustrated in FIG. 7.

The ram 68 is actuated by an electrically actuated piston body 80 which is securely received in a second end 78 of the longitudinal passageway 64 of the housing 60. The piston body 80 has a piston member 82 positioned so as to engage the ram 68 and move the ram 68 in a linear fashion upon actuation of the piston body 80. In the preferred embodiment, the electrically actuated piston body 80 is defined by an electrically actuated squib containing an explosive material 84 for generating high pressure gas for actuating the piston member 82. In one embodiment, the explosive material 84 is gun powder. However, it will be appreciated by those skilled in the art that other explosive materials could also be used to generate a high pressure gas and thereby drive the piston member 82. In an alternate embodiment, illustrated in FIGS. 7–9, the electrically actuated piston body 80' is defined by an electrically operated solenoid having an extensible piston member 82'.

A controller 100 is responsive to at least one sensor (not shown) and is in electrical communication with said electrically actuated piston body 80. In this regard, the sensor, be it a thermocouple, a heat sensor, or a smoke sensor, or multiple combinations, is selected for sensing at least one product of combustion. Upon detection such a product of combustion, the controller 100, which can be a programmable logic controller or other digital or analog control circuit, sends an electrical signal or impulse to the piston body 80. This electrical signal actuates the piston member 82 which engages the ram 68 and accelerates the ram 68 causing the ram to drive the piercing agent 45 in a linear fashion thereby piercing the pierceable seal disposed on the outlet 22 of the second canister 20. Those skilled in the art will recognize that upon the piercing of the pierceable seal disposed on the outlet 22 of the second canister 20, the agitation/pressurization agent flows through the actuating valve stem 40 into the second canister 15. The discharge mechanism 30 can include a rupture disc as taught by the '635 patent, or other means for allowing the pressurized fire suppressant agent to flow through the discharge mechanism 30 upon actuation of the fire suppression system 10.

A manifold, represented schematically at 105 delivers the fire suppressant agent from the discharge mechanism 30 to one or more areas to be protected by the fire suppression system 10. While the fire suppression system 10 is readily adaptable to both vehicular and marine applications, it has particular benefit in a recreational vehicle, or RV (not shown). In this regard, the system could be energized by the generator and the manifold 105 could deliver the fire suppression agent to the engine compartment and the generator compartment. Additionally, the manifold 105 could deliver fire suppressant to the cooking galley of the RV.

From the foregoing description, it will be recognized by those skilled in the art that an improved fire suppression system has been provided. The fire suppression system provides for automatic actuation upon detection of a fire and also allows selective manual actuation and is an improvement over the fire suppression system of the '635 patent.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

I claim:

1. In a fire suppression system having a first canister containing a fire suppressing agent, said first canister having an inlet and an outlet defining a neck for receiving a discharge mechanism; a second canister containing an agitating and pressurizing agent, said second canister having an outlet and a pierceable seal disposed about said outlet; and an actuating mechanism for establishing a fluid communication between said first and said second canisters, said actuating mechanism having an actuating valve stem received within said inlet of said first canister, a piercing agent for piercing said pierceable seal and a linkage in operative engagement with said piercing agent for providing manual actuation of said fire suppression system, wherein the improvement comprises:

a housing proximate said actuating mechanism, said housing having a longitudinal passageway collinear with said piercing agent;

a ram disposed in a first end of said longitudinal passageway and positioned so as to be engageable with said piercing agent, said ram being substantially cylindrical and having a slot disposed in a first end, said slot for receiving at least a portion of said linkage;

an electrically actuated piston body disposed in a second end of said longitudinal passageway, said piston body having a piston member positioned so as to engage said ram and move said ram in a linear fashion upon actuation of said piston body; and a controller responsive to at least one sensor in electrical communication with said electrically actuated piston body and for communicating an electrical signal to said piston body upon detection of at least one product of combustion.

2. The fire suppression system of claim 1 wherein said electrically actuated piston body is defined by an electrically operated solenoid having an extensible piston.

3. In a fire suppression system having a first canister containing a fire suppressing agent, said first canister having an inlet and an outlet defining a neck for receiving a discharge mechanism; a second canister containing an agitating and pressurizing agent, said second canister having an outlet and a pierceable seal disposed about said outlet; and an actuating mechanism for establishing a fluid communication between said first and said second canisters, said actuating mechanism having an actuating valve stem received within said inlet of said first canister, a piercing agent for piercing said pierceable seal and a linkage in operative engagement with said piercing agent for providing manual actuation of said fire suppression system, wherein the improvement compnses:

a housing proximate said actuating mechanism, said housing having a longitudinal passageway collinear with said piercing agent;

a ram disposed in a first end of said longitudinal passageway and positioned so as to be engageable with said piercing agent, said rain being substantially cylindrical and having a slot disposed in a first end, said slot for receiving at least a portion of said linkage;

an electrically actuated piston body disposed in a second end of said longitudinal passageway, wherein said electrically actuated piston body is defined by an electrically actuated squib, said squib having a piston member positioned so as to engage said ram and move said ram in a linear fashion upon actuation of said piston body and further wherein said squib contains an explosive material for generating high pressure gas for actuating said piston member; and a controller responsive to at least one sensor in electrical communication with said electrically actuated piston body and for communicating an electrical signal to said piston body upon detection of at least one product of combustion.

4. The fire suppression system of claim 3 wherein said explosive material is gun powder.

* * * * *